US010411376B1

(12) United States Patent
Wang et al.

(10) Patent No.: US 10,411,376 B1
(45) Date of Patent: Sep. 10, 2019

(54) PSAS FEMALE CONNECTOR

(71) Applicant: AMPHENOL EAST ASIA ELECTRONIC TECHNOLOGY (SHEN ZHEN) CO., LTD., Shen Zhen, Guangdong Province (CN)

(72) Inventors: Xiang Wang, Shen Zhen (CN); Yan-Bin Tan, Shen Zhen (CN); Lei Liao, Shen Zhen (CN); Chuan-Qi Gong, Shen Zhen (CN)

(73) Assignee: AMPHENOL EAST ASIA ELECTRONIC TECHNOLOGY (SHEN ZHEN) CO., LTD., Shen Zhen, Guangdong Province (CN)

( * ) Notice: Subject to any disclaimer, the term of this patent is extended or adjusted under 35 U.S.C. 154(b) by 0 days.

(21) Appl. No.: 16/132,807

(22) Filed: Sep. 17, 2018

(51) Int. Cl.

| | |
|---|---|
| ***H01R 12/71*** | (2011.01) |
| ***H01R 13/6581*** | (2011.01) |
| ***H01R 12/72*** | (2011.01) |
| ***H01R 13/6461*** | (2011.01) |
| ***H01R 13/502*** | (2006.01) |
| ***H01R 12/55*** | (2011.01) |
| ***H01R 13/02*** | (2006.01) |

(52) U.S. Cl.
CPC ..... *H01R 12/716* (2013.01); *H01R 12/55* (2013.01); *H01R 12/727* (2013.01); *H01R 13/02* (2013.01); *H01R 13/502* (2013.01); *H01R 13/6461* (2013.01); *H01R 13/6581* (2013.01)

(58) Field of Classification Search
CPC ..... H01R 12/716
USPC ..... 439/74
See application file for complete search history.

(56) References Cited

U.S. PATENT DOCUMENTS

| | | | | |
|---|---|---|---|---|
| 8,585,440 | B2 * | 11/2013 | Jiang | H01R 13/6477 439/626 |
| 9,077,118 | B2 * | 7/2015 | Szu | H01R 24/00 |
| 9,407,022 | B1 * | 8/2016 | Wang | H01R 13/6275 |
| 9,409,331 | B2 * | 8/2016 | Liu | H01R 12/725 |
| 9,564,714 | B1 * | 2/2017 | Wang | H01R 13/6461 |
| 9,941,641 | B1 * | 4/2018 | Jiang | H01R 13/6585 |
| 2012/0077389 | A1 * | 3/2012 | Zhang | H01R 24/60 439/660 |
| 2017/0338592 | A1 * | 11/2017 | Doi | H01R 13/6315 |
| 2018/0076558 | A1 * | 3/2018 | Tan | H01R 12/71 |

* cited by examiner

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

A PSAS female connector includes a body member, a terminal assembly, and a conductive member. The body member has a conductive groove and a tooth recess. The conductive groove is on a lateral side of the body member. The tooth recess is at an inner side of an edge of the conductive groove. The conductive member has a protrusion tooth and a protrusion strip, and is engaged in the conductive groove. The protrusion tooth is at an outer side of an edge of the conductive member. When the conductive member is engaged in the conductive groove, the protrusion tooth is geared to be engaged with the tooth recess. When the terminal assembly is engaged in the terminal groove, the protrusion strip and the terminal assembly are engaged with each other, thus improving the combination between the conductive member and the conductive groove.

6 Claims, 3 Drawing Sheets

PSAS FEMALE CONNECTOR

BACKGROUND OF THE INVENTION

1. Field of the Invention

The present invention relates to connectors, and more particularly, to a PSAS female connector.

2. Description of the Related Art

An SAS refers to a small scale computer system interface or Serial Attached SCSI, which is a computer hub technique applied for data transmission of peripheral components, such as an interface for equipment including a hard drive or CD-ROM. The SAS interface is derived from a parallel SCSI physical storage interface. Compared with the parallel manner, the serial manner of SAS interface provides a faster communication transmission rate and a simpler configuration. Also, SAS is compatible for serial ATA (SATA) equipment, wherein those interfaces applies a similar cable standard.

A PCI-e (peripheral component interconnect express) refers to a high speed serial computer expansion bus standard. PCI-e is a high speed point-to-point double-channel with large transmission bandwidth. The equipment connected with PCI-e has the whole channel bandwidth instead of sharing the bus bandwidth. Such configuration is mainly applied for supporting an active power management, error report, reliable end-to-end transmission, hot pluggable usage, and quality of service (QOS) functions, achieving the advantage of a high speed data transmission. Presently, the 16× 2.0 version reaches a transmission speed of 10 GB/s, and such speed may still be improved further.

A "PSAS" connector refers to a connector which supports both PCI-e (Peripheral Component Interconnect Express) and SAS (Serial Attached SCSI) interfaces.

As the data storage amount continuously increasing, the transmission rate of the connector needs to be improved as well, especially for the server storage industry. The clock rate shall be increased, and the rising time shall be rapidly shortened. Also, the bandwidth and transmission rate of the connector is desired to be higher. With the rising demand of the increasing transmission rate, the terminal connection stability in the connector needs to be increased as well.

SUMMARY OF THE INVENTION

For improving the issues above, a PSAS female connector is disclosed for fulfilling the demand upon the stability of the connection due to the continuously increasing transmission rate.

For achieving the aforementioned objectives, the present provides a PSAS female connector comprising a body member, a terminal assembly, and a conductive member.

The body members is formed of plastic material and has a conductive groove and a tooth recess.

The conductive groove is disposed on a lateral side of the body member.

The tooth recess is disposed at an inner side of an edge of the conductive groove.

The conductive member is formed of plastic material and has a protrusion tooth and a protrusion strip. The conductive member is engaged in the conductive groove to be fixed to the body member.

The protrusion tooth is disposed at an outer side of an edge of the conductive member. When the conductive member is engaged in the conductive groove, the protrusion tooth is geared to be engaged with the tooth recess.

The conductive member is engaged in the conductive groove, and when the terminal assembly is engaged in the terminal groove, the protrusion strip and the terminals are engaged.

Preferably, the body member includes a terminal groove disposed in the body member. The terminal assembly includes a signal terminal and a power terminal. The terminal assembly is inserted in the terminal groove in the body member.

Preferably, at least two tooth recesses are included.

Preferably, at least two protrusion teeth are included.

Preferably, the conductive member is divided into two segments.

Preferably, the PSAS female connector includes a fix member disposed on two ends of the body member.

With such configuration, the present invention achieves following advantages.

Compared to the disclosed techniques, the present invention provides the PSAS female connector according to the future market demand, wherein several novel features are included. The connection stability is improved. First, the conductive member has a protrusion tooth structure on the edge thereof, and the conductive groove has a tooth recess structure on the inner edge thereof corresponding to the protrusion tooth. By the engagement between a plural pairs of protrusion teeth and teeth recesses, the combination force between the conductive member and the conductive groove is greatly improved. Second, the protrusion strip is applied for the contact between the conductive member and the terminals, so as to increase the fraction therebetween, thus improving the contact stability of the terminal assembly and the conductive member. Third, the special terminal structures allow the SAS0 channel to be applied for PCIe application. Fourth, the terminals apply an inset molding structure, so as to simplify the manufacturing process and save the time cost thereof. Also, terminals are fixed and prevented from detachment. Through the structural optimization, the SAS channel reaches a transmission rate of a PCIe channel (32 Gbps for a single direction channel). Also, a total of six channels (X6) are allowed to be simultaneously used for transmission.

Preferably, the fix member is disposed on two ends of the body member, and the fix member is directly welded on the PCB.

DETAILED DESCRIPTION OF THE INVENTION

Figure 1:
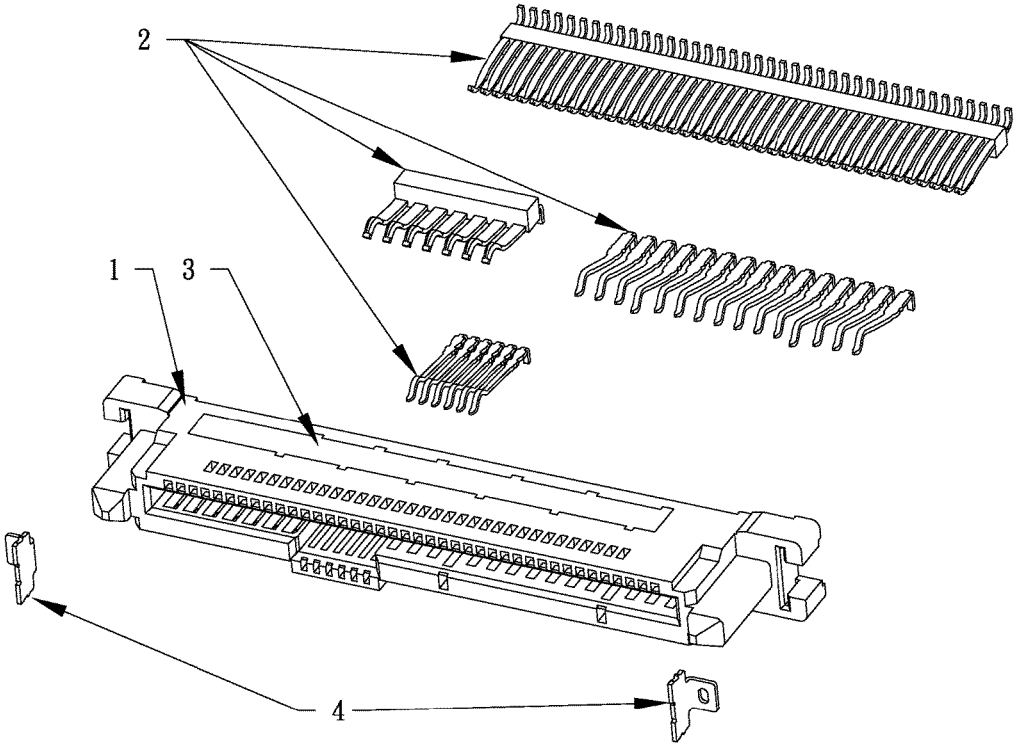
FIG. 1 is an exploded view of the PSAS female connector.
Figure 2:
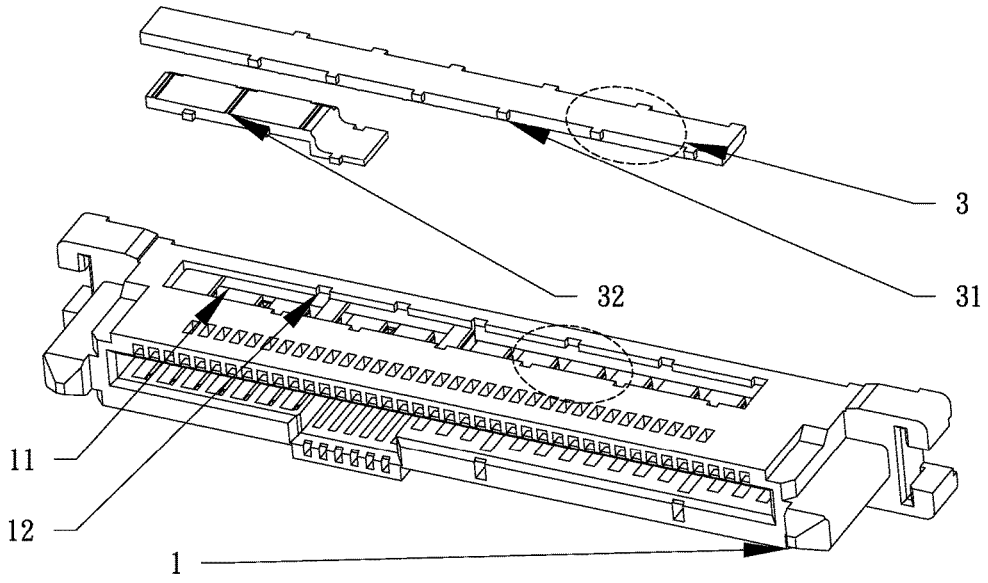
FIG. 2 is a schematic view illustrating the conductive member, conductive groove, protrusion tooth, and protrusion recess in accordance with an embodiment of the present invention.
Figure 3:
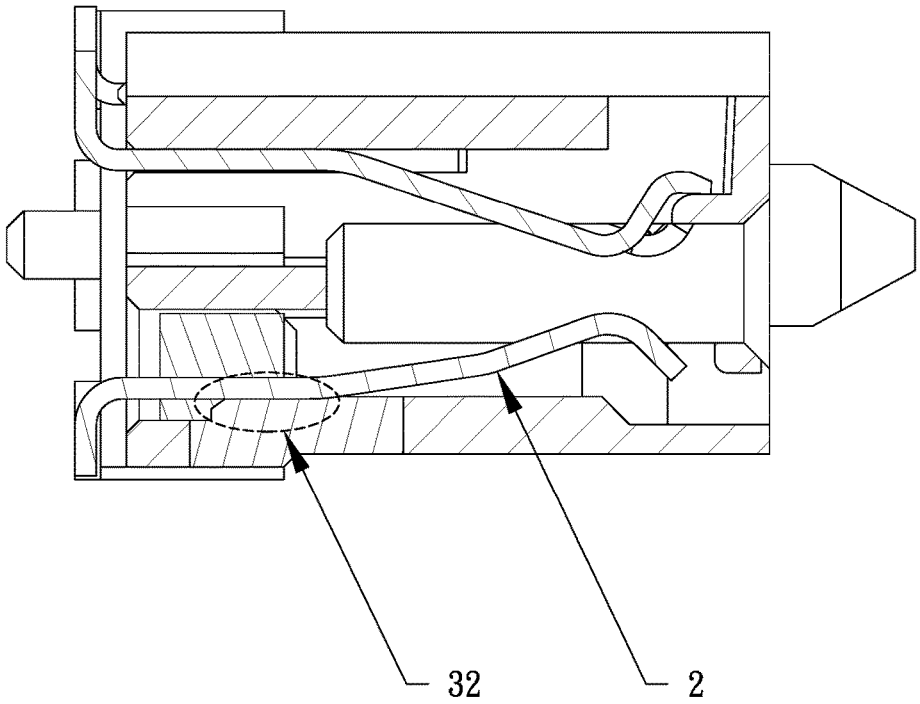
FIG. 3 is a sectional view illustrating the engagement of the protrusion strip and the terminal assembly.

The aforementioned and further advantages and features of the present invention will be understood by reference to the description of the preferred embodiment in conjunction with the accompanying drawings from FIG. 1 to FIG. 3 where the components are illustrated based on a proportion for explanation but not subject to the actual component proportion.

Embodiment 1

Referring to FIG. 1, a PSAS female connector comprises a body member 1, a terminal assembly 2, a conductive member 3, and a fix member 4.

Referring to FIG. 2, the body member 1 comprises a conductive groove 11, a tooth recess 12, and a terminal groove inside the body member 1. The body member 1 is formed of plastic material.

The conductive groove 11 is disposed on a lateral side of the body member 1.

The tooth recess 12 is disposed at an inner side of an edge of the conductive groove 11. At least two tooth recesses 12 are included.

The terminal assembly 2 includes a signal terminal and a power terminal that are able to be inserted in the terminal groove in the body member 1.

The conductive member 3 is formed of plastic material and has a protrusion tooth 31 and a protrusion strip 32. Also, the conductive member 3 is divided into two segments.

The conductive member 3 is engaged in the conductive groove 11 to be fixed to the body member 1.

The protrusion tooth 31 is disposed at an outer side of an edge of the conductive member 3. At least two protrusion teeth 31 are provided. When the conductive member 3 is engaged in the conductive groove 11, the protrusion tooth 31 is geared to be engaged with the tooth recess 12.

Referring to FIG. 3, the conductive member 3 is engaged in the conductive groove 11, and when the terminal assembly 2 is engaged in the terminal groove, the protrusion strip 32 and the terminals are engaged.

The fix member 4 is disposed on two ends of the body member.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A PSAS female connector comprising a body member, a terminal assembly, and a conductive member;

the body member being formed of plastic material and having a conductive groove, a tooth recess, and a terminal groove disposed in the body member;

the conductive groove being disposed on a lateral side of the body member;

the tooth recess being disposed at an inner side of an edge of the conductive groove;

the conductive member being formed of plastic material and having a protrusion tooth and a protrusion strip, the conductive member being engaged in the conductive groove to be fixed to the body member;

the protrusion tooth being disposed at an outer side of an edge of the conductive member; when the conductive member is engaged in the conductive groove, the protrusion tooth is geared to be engaged with the tooth recess; and when the conductive member is engaged in the conductive groove, and when the terminal assembly is engaged in the terminal groove, the protrusion strip and the terminal assembly are engaged with each other.

2. The PSAS female connector of claim 1, wherein the terminal assembly includes a signal terminal and a power terminal, and the terminal assembly is inserted in the terminal groove in the body member.

3. The PSAS female connector of claim 1, wherein at least two tooth recesses are included.

4. The PSAS female connector of claim 1, wherein at least two protrusion teeth are included.

5. The PSAS female connector of claim 1, wherein the conductive member is divided into two segments.

6. The PSAS female connector of claim 1, further comprising a fix member disposed on two ends of the body member.

* * * * *